United States Patent [19]

Schumacher et al.

[11] Patent Number: 4,504,404

[45] Date of Patent: Mar. 12, 1985

[54] LUBRICANT COMPOSITIONS CONTAINING CHLORINATED ORGANIC COMPOUNDS

[75] Inventors: Rolf Schumacher, Pfeffingen; Arnold Grubenmann, Binningen, both of Switzerland

[73] Assignee: Ciba-Geigy Corporation, Ardsley, N.Y.

[21] Appl. No.: 631,510

[22] Filed: Jul. 16, 1984

Related U.S. Application Data

[62] Division of Ser. No. 406,669, Aug. 9, 1982, abandoned.

[30] Foreign Application Priority Data

Aug. 20, 1981 [CH] Switzerland ..... 5382/81

[51] Int. Cl.[3] ..... C10M 1/54

[52] U.S. Cl. ..... 252/33.4; 252/32.5; 252/32.7 E; 252/49.7; 252/51; 252/58

[58] Field of Search ..... 252/49.7, 50, 51, 58, 252/32.5, 32.7 E, 33.4

[56] References Cited

U.S. PATENT DOCUMENTS

| | | | |
|---|---|---|---|
| 2,121,824 | 6/1938 | Prutton | 252/58 |
| 2,308,622 | 1/1943 | Lincoln et al. | 252/58 |
| 2,320,984 | 6/1943 | Prutton | 252/58 |
| 2,330,238 | 9/1944 | Prutton | 252/58 |
| 3,010,904 | 11/1961 | Odell | 252/51.5 R |
| 3,219,710 | 11/1965 | Weil | 252/58 |
| 3,226,325 | 12/1965 | Wilson | 252/58 |
| 3,432,436 | 3/1969 | Nail | 252/54 |
| 3,499,840 | 3/1970 | Williams | 252/54 |
| 4,022,700 | 5/1977 | Harris | 252/51.5 A |

OTHER PUBLICATIONS

W. Daver; J. Inst. Petroleum, 31 73 (1945).

*Primary Examiner*—Jacqueline V. Howard
*Attorney, Agent, or Firm*—Luther A. R. Hall

[57] ABSTRACT

The load-carrying capacity of liquid lubricants having a kinematic viscosity of 2 to 1500 $mm^2/s$ at 40° C. can be substantially improved by the addition of oil-insoluble, dispersible aromatic compounds which are chlorine-substituted in the nucleus. The compounds, which consist of 1 to 4 completely unsaturated or partially saturated aromatic moieties which may contain heteroatoms and are linked to one another through a simple direct bond, a double bond or through —O—, —S—, —N(R)—, —N=, alkylene, —NHCO—, —N=CH—, —N=N—, —N=NCH(COCH$_3$)CONH, —CH=N—N=CH— or =N—(Y)—N=, contain from 2 to 24 aromatic chlorine atoms. The combination of the additives of the invention with conventional antiwear additives has been found to be particularly advantageous.

8 Claims, No Drawings

LUBRICANT COMPOSITIONS CONTAINING CHLORINATED ORGANIC COMPOUNDS

This is a divisional of application Ser. No. 406,669, filed Aug. 9, 1982, now abandoned.

The present invention relates to lubricant oils containing, as extreme pressure additives, oil-insoluble, dispersible aromatic compounds which are chlorine-substituted in the nucleus.

Lubricating oils must be provided with a very good load-carrying capacity in order to transmit power under severe conditions of load. To this end extreme pressure additives are added to lubricants. The additives principally used at the present time are compounds which contain sulfur and phosphorus, e.g. dithiophosphates. The requirement made of these compounds is that they shall be readily soluble in oil. It has also been found that oil-soluble chlorinated aromatics increase the load-carrying capacity of lubricants, although they also have the drawback of exerting a corrosive action on the metal parts which it is desired to protect. For example, U.S. Pat. Nos. 2,308,622 and 2,330,238 disclose diphenyldichloromethane and o-dichlorobenzene respectively as additives for lubricating oils. In general, however, compounds of this kind have attained only limited importance, as their effectiveness does not meet the exacting requirements of practice. In J. Inst. Petroleum 31, 73 (1945), W. Davey shows that chlorinated aromatics have poorer extreme pressure properties than chlorinated aliphatics, and also that alkylaromatics which are chlorinated in the side chain are able to increase the load-carrying capacity far better than products which are chlorinated in the nucleus.

In lubricant technology, the use of unchlorinated or chlorinated pigments as thickeners has attained much greater importance in the production of lubricating greases. Lubricating greases are substances which, on account of their rheological properties, separate rubbing surfaces to minimise friction and wear. At low shear stresses, the behaviour of such compounds is similar to that of solids. A lubricating grease will therefore contain, as additive, a substantial amount of a thickener which imparts to the grease the mechanical resistance to low shear rates. Examples of suitable thickeners are the azo dyes disclosed in U.S. Pat. No. 4,022,700 and the dioxazines disclosed in U.S. Pat. No. 3,010,904, which constitute up to 50% by weight of the lubricant.

Surprisingly, it has now been found that the load-carrying capacity of liquid lubricants is improved by the addition of oil-insoluble, dispersible aromatic compounds which are chlorine-substituted in the nucleus.

Accordingly, the present invention provides liquid lubricant compositions having a kinematic viscosity of 2 to 1500 $mm^2/s$ at 40° C. and containing, as extreme pressure additive, 0.01 to 4.5% by weight, based on the lubricant, of an oil-insoluble, dispersible aromatic compound which is chlorine-substituted in the nucleus.

Virtually independent of the respective structure of the compounds, the aromatic compounds which are chlorine-substituted in the nucleus are highly effective extreme pressure additives so long as they are insoluble in the lubricant. It has been found that the dispersibility of the compounds of this type constitutes no problem and in many cases the use of conventional dispersants may even be dispensed with.

Suitable aromatic moieties are both completely unsaturated and partially saturated aromatic systems which may also contain hetero-atoms.

Examples of suitable completely unsaturated aromatic moieties are: benzene, naphthalene, phenanthrene, triphenylene, chrysene; 3,4-benzophenanthrene; 1,2-benzochrysene, 5,6-benzochrysene, picene; 3,4,5,6-dibenzophenanthrene; 1,2,7,8-dibenzochrysene, anthracene, tetraphene; 1,2,3,4-dibenzanthracene; 1,2,5,6-dibenzanthracene; 1,2,7,8-dibenzanthracene; 1,2-benzotetraphene, fluoroanthene, indacene, biphenylene; 1,2-benzobiphenylene, perylene; 1,2,7,8-dibenzoperylene; 1,12-benzoperylene, pyrene, anthrene, fluoroanthene, pentaphene, tetracene or 1,2-benzotetracene.

Examples of partially saturated aromatic moieties are: fluorene, indene, pernaphthene, benzanthrene, naphthoperinaphthene or dibenzperinaphthene.

Examples of aromatic moieties which contain hetero-atoms are those which are derived from pyridine, quinoline, isoquinoline, benzoquinoline, pyrazine, pyrimidine, pyridazine, triazine, pyrrole, imidazole, isoindoline, isoindolinone, indolone, phthalic anhydride, phthalimide, isoindole, indole, indolizine, indazole, naphtridine, acridine, phenanthridine, benztriazole, carbazole, carboline, phenazine, oxazole, benzoxazole, benzoxazine, phenoxazine, thiazole, phenothiazine, furane, pyrane, pyrone, coumarin, chromone, chromene, chromane, indone, flavone, benzofuran, dibenzofuran, synthene, phenoxathine, thiophene, benzothiophene, thioindoxyl, naphthothiophene, thianthrene, 1,3-isoindoledione, anthraquinone, thionaphthenone, 1,3-indanedione; pyrazolone, benzanthrone, anthrapyrimidine, anthraquinonebenzacridon, pyrazolanthrone, N-methylanthrapyridone, thiazolanthrone, dioxazine, isocyanuric acid or barbituric acid.

The aromatic compounds which are chlorine-substituted in the nucleus and are eligible for use in the practice of this invention may have one or up to four of the aromatic moieties exemplified above. The entire molecule may be perchlorinated, i.e. all hydrogen atoms in the molecule, or at least the hydrogen atoms attached to aromatic moieties, are replaced by chlorine, or the compounds are only partially chlorinated, in which case the following groups may be present in addition to chlorine and hydrogen: amino, alkyl, sulfo and carboxyl in the form of the free acid or salts thereof, sulfonamido, alkoxy, trichloromethyl, trichloroethyl, hydroxy and/or nitro.

In addition to chlorine and hydrogen, preferred substituents are methyl, ethyl, methoxy, ethoxy and nitro.

If an eligible aromatic compound which is chlorine-substituted in the nucleus consists of only one of the moieties specified above, then it is e.g. hexachlorobenzene, octachloronaphthalene, and preferably tetrachloroisoindolinone, tetrachlorophthalic anhydride, an isoindolinone of the formula

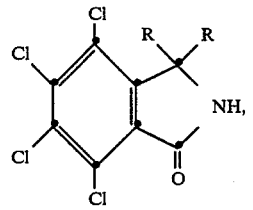

wherein R is methoxy or chlorine, as in 3,3,4,5,6,7-hexachloroisoindolinone, a 2-methylanthraquinone containing up to 7 carbon atoms, a thioindoxyl containing up to 4 aromatic chlorine atoms, such as the compound of the formula

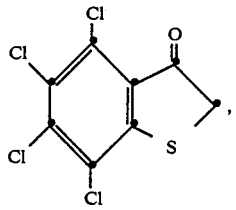

a dioxazine containing up to 10 chlorine atoms, a fluorene containing up to 10 chlorine atoms, e.g. perchlorinated decachlorofluorene, a dibenzofuran containing up to 8 chlorine atoms, a benzothiophene containing up to 4 chlorine atoms, decachloroanthracene, dodecachloroperylene, decachlorofluoroanthene, hexadecachloro-1,2,7,8-dibenzchrysene or tetradecachlorodibenzperinaphthene.

If an eligible aromatic compound which is chlorine-substituted in the nucleus consists of two or more of the moieties specified above, then these may be linked to one another through a simple direct bond, a double bond, through —O—, —S—, —N(R)—, —N=, alkylene, —NHCO—, —N=N—, —N=NCH(COCH$_3$)CONH—, —CH=N—N=CH— or through =N—(Y)—N=, where R is hydrogen or $C_1$–$C_4$alkyl such as methyl, ethyl, isopropyl or n-butyl, and Y is the direct bond or alkylene, e.g. $C_2$–$C_4$alkylene such as ethylene, 1,3-propylene, tetramethylene, ethylethylene or 2,2-propylidene. In preferred compounds, up to four of the moieties are linked to one another and each of the linkages in the compounds may be the same or different.

Many of these so linked moieties form compounds which are suitable for salt formation or chelation. These salts and/or chelates are equally suitable as additives for lubricants.

If two or more moieties are linked by one or more simple bonds, they are e.g. biphenyl containing up to 10 chlorine atoms, terphenyl containing up to 14 carbon atoms, dinaphthalene containing up to 12 chlorine atoms, compounds of the formulae

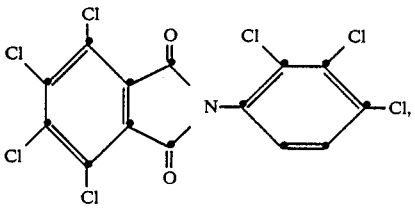

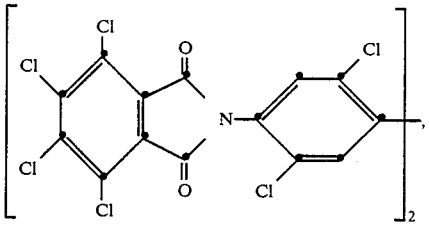

-continued

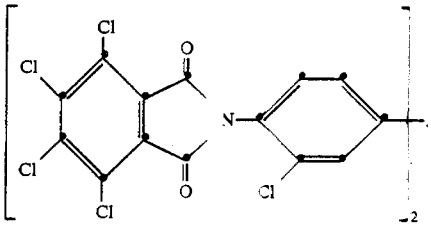

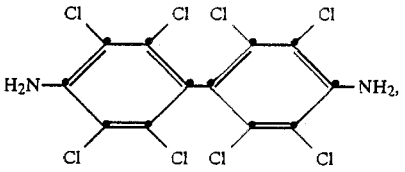

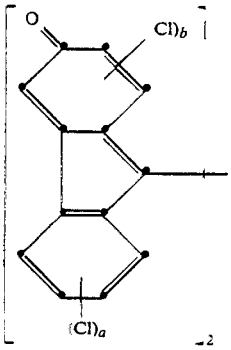

wherein a is 1 to 4 and b is 1 to 3, a triazine derivative containing up to 15 chlorine atoms, of the formula

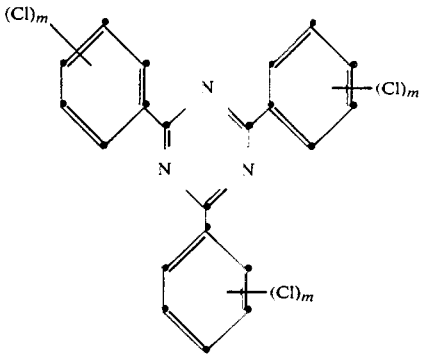

wherein m is 0 to 5.*

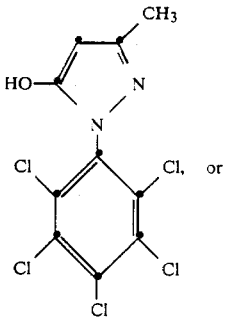

-continued

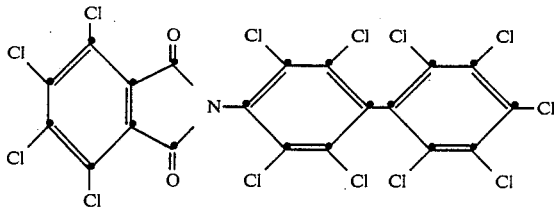

*The subscripts a, b, d and m employed in the formulae listed below may also be zero according to the definition. However, it is to be noted that the entire molecule must always contain aromatic moieties which are chlorine-substituted in the nucleus. Several subscripts a, b, d and m in the molecule may be the same or different.

If two or more moieties are linked by one or more double bonds they may be e.g.

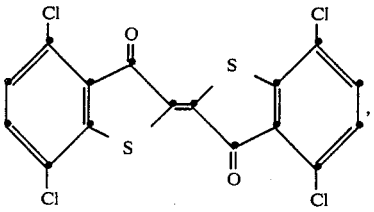

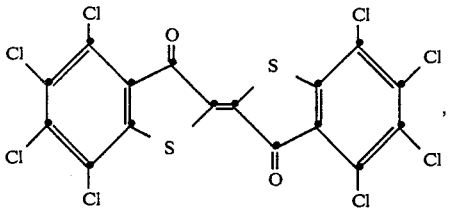

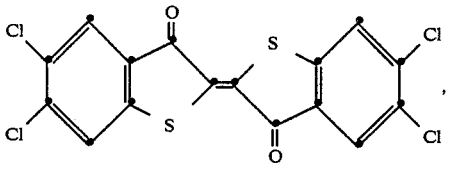

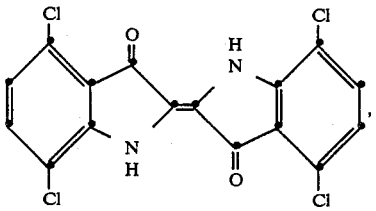

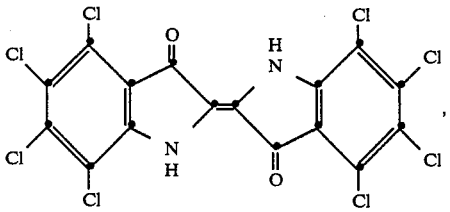

-continued

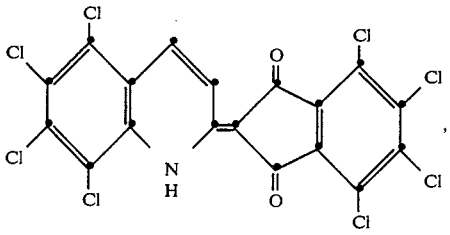

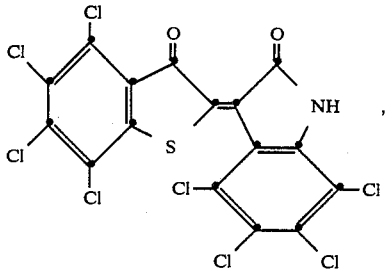

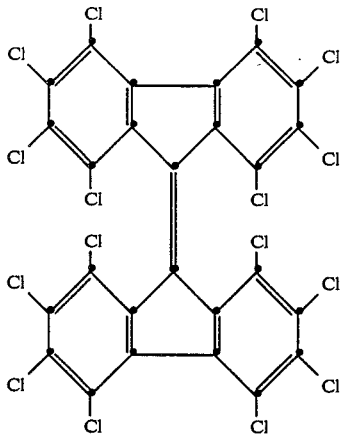

or

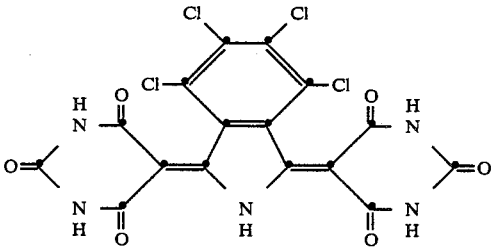

If two or more moieties are linked through —O— or —S—, they may be e.g.

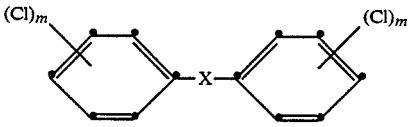

or

-continued
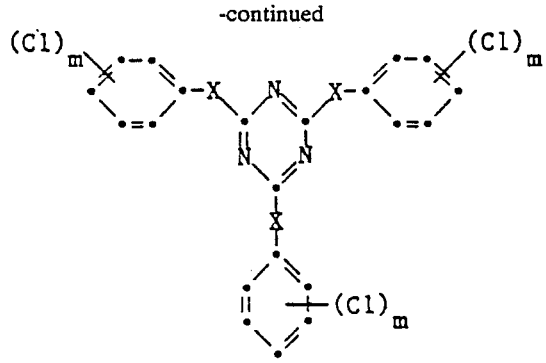
wherein X is —O— or —S— and m is 0 to 5.
If two or more moieties are linked through a —N(-R)— group, wherein R is hydrogen or $C_1$–$C_4$alkyl, they may be e.g.
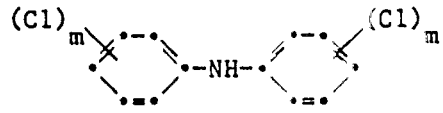
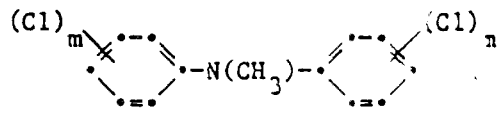
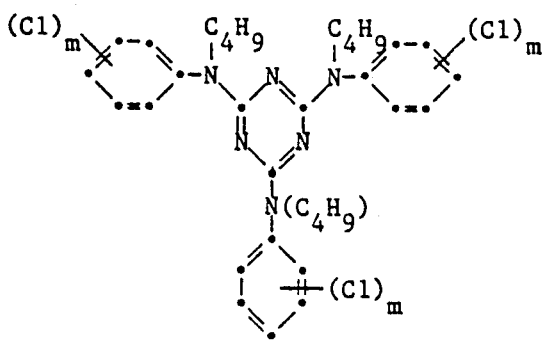
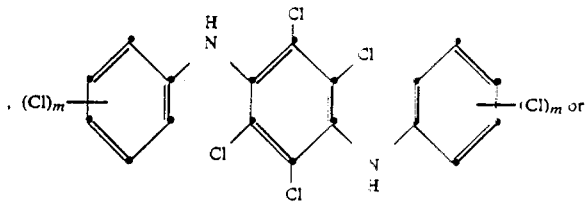
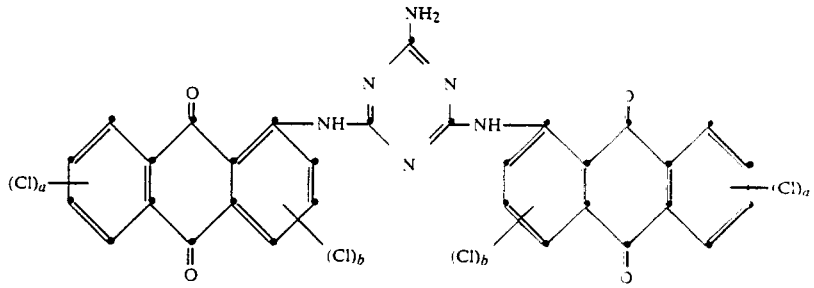
wherein m is 0 to 5, a is 0 to 4 and b is 0 to 3.
If two or more moieties are linked through —N=, they may be e.g.
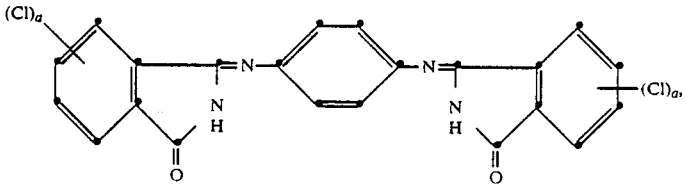
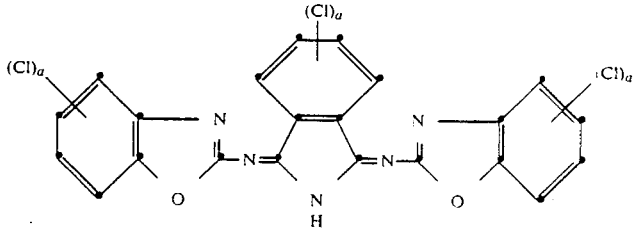

-continued
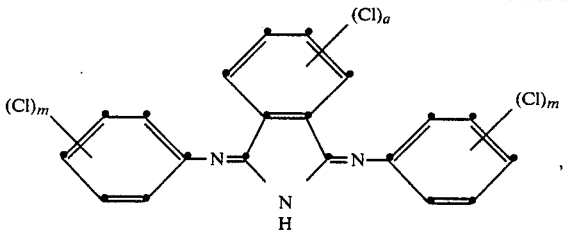
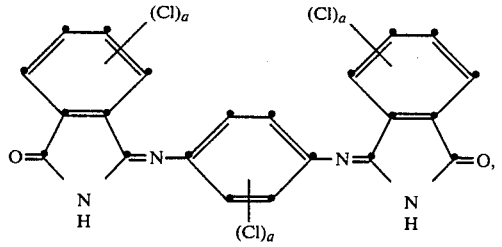
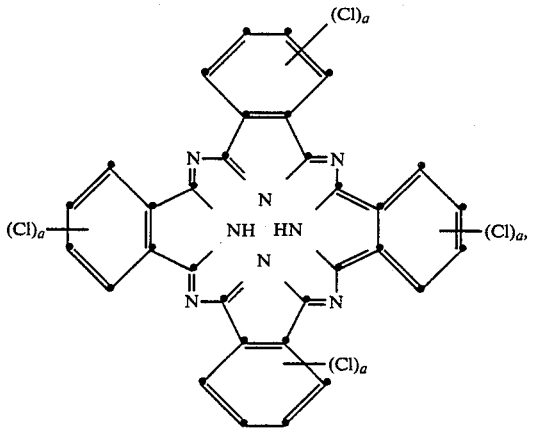
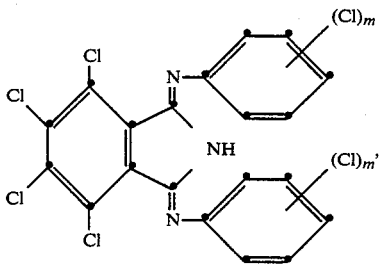
wherein a is 1 to 4, and m is 0 to 5.
If two or more moieties are linked through $C_1$-$C_4$alkylene, they may be e.g. compounds such as
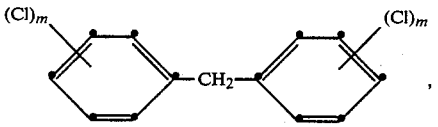
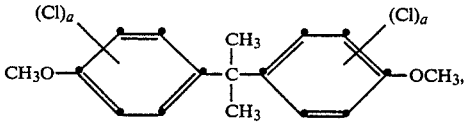
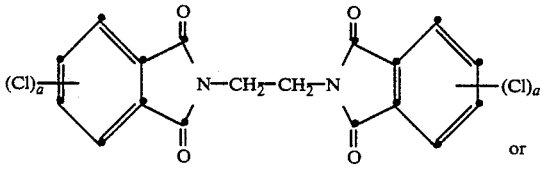
or
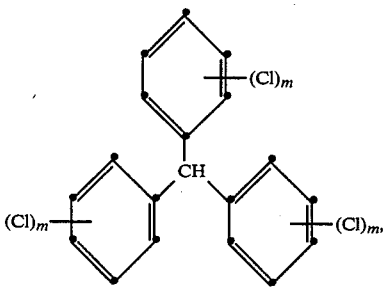
wherein m is 0 to 5 and a is 0 to 4.
If two or more moieties are linked through a —NH-CO— group, they may be e.g.
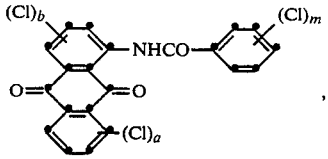
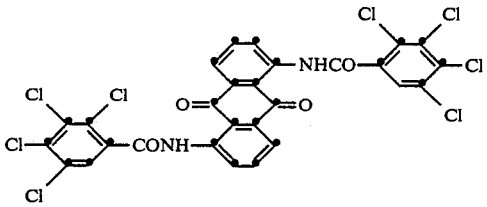
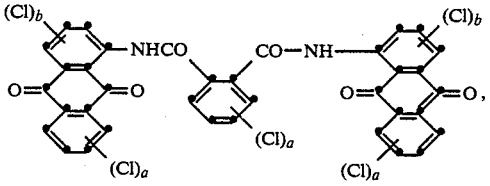
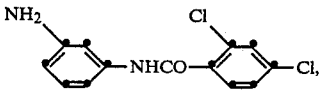
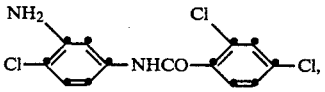
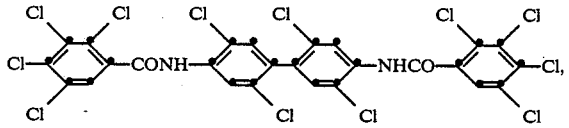

-continued
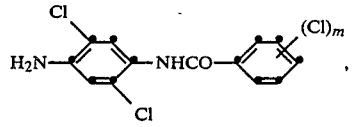
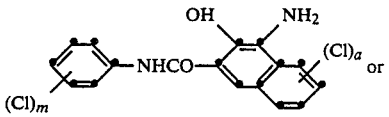
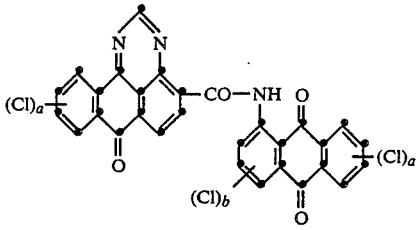
wherein a is 0 to 4, b is 0 to 3 and m is 1 to 5.
If two or more moieties are linked through a —N=CH— group, they may be e.g. compounds such as
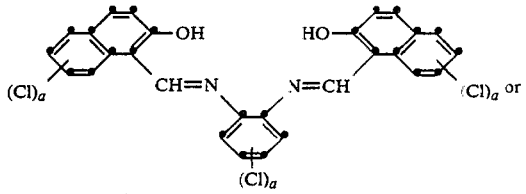
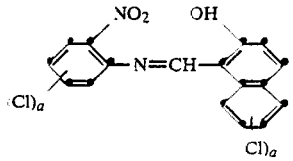
wherein a is 0 to 4.
If two or more moieties are linked through a —N=N— group, they may be e.g.
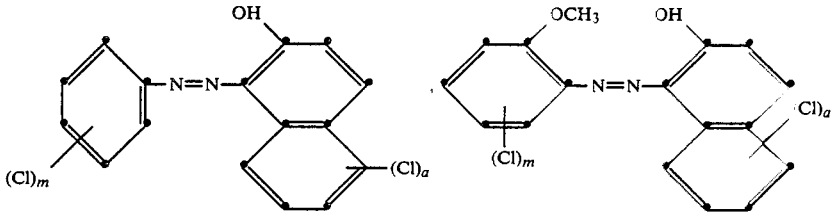
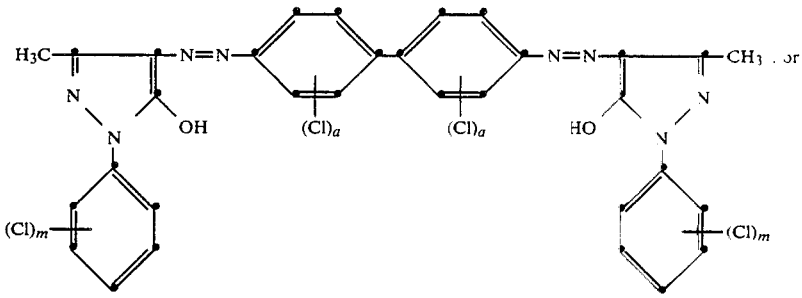
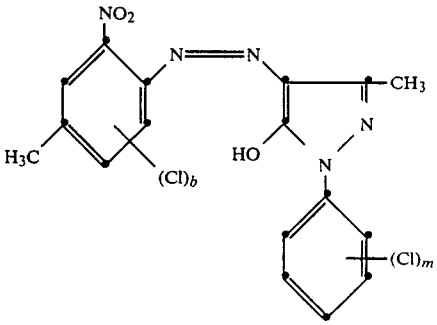
wherein a is 0 to 4, b is 0 to 3 and m is 0 to 5.
If two or more moieties are linked through a —N=NCH(COCH$_3$)CONH— group, they may be e.g.

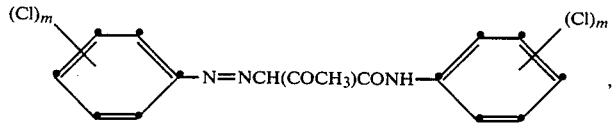

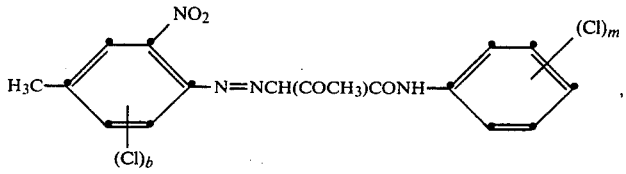

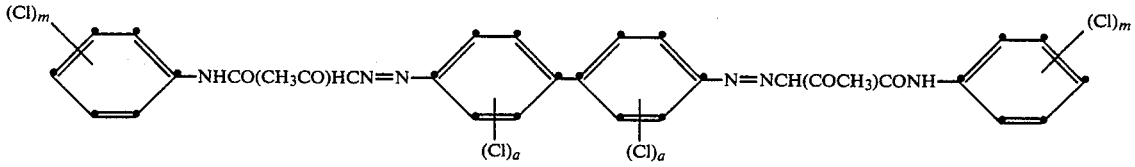

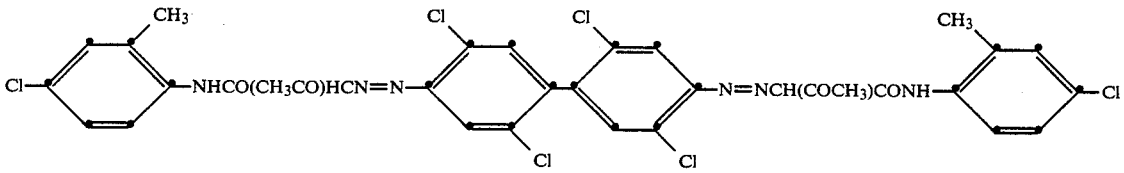

or

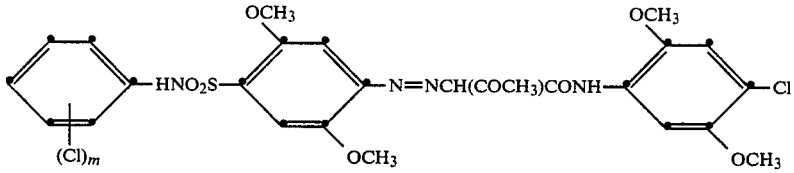

wherein a is 0 to 4, b is 0 to 3 and m is 0 to 5.

If two or more moieties are linked through a —CH=N—N=CH— group, they may be e.g.

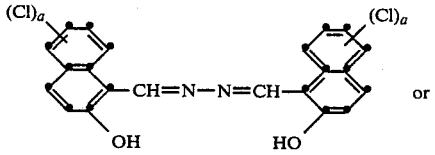

or

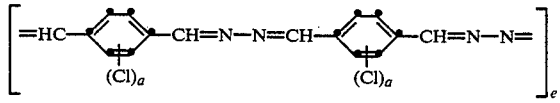

wherein each of a and e is 1 to 4.

If two or more moieties are linked through a =N—(Y)—N= group, wherein Y has the meaning assigned to it, they may in particular be compounds such as

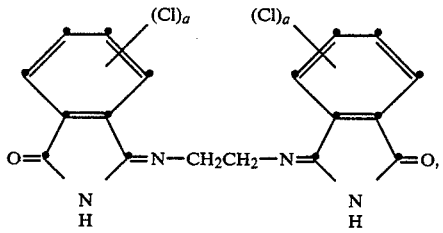

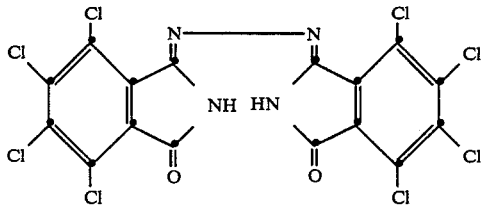

wherein a is 0 to 4.

If several moieties are linked through different groups, they may be e.g. compounds such as

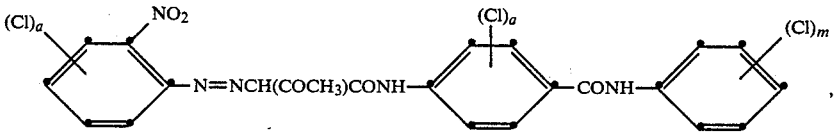

-continued

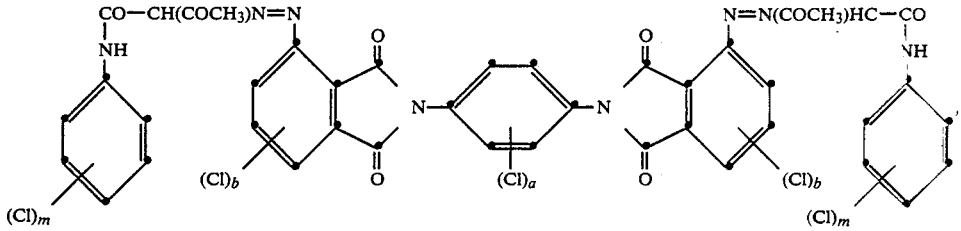

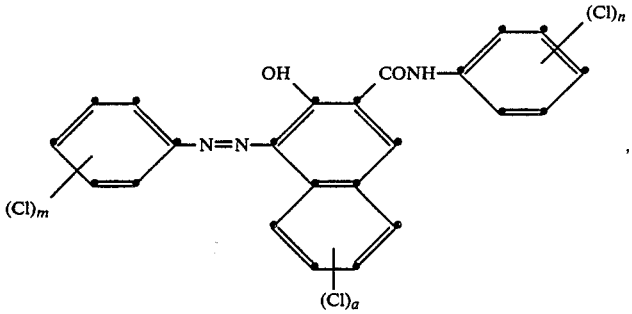

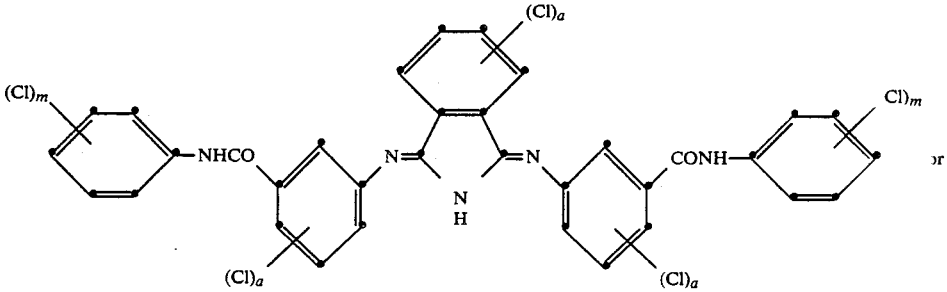

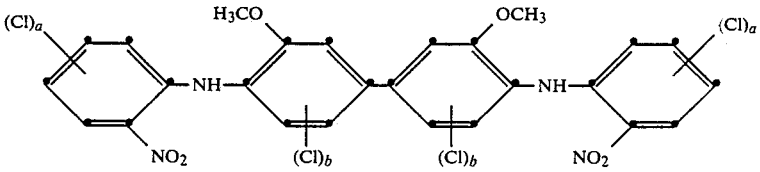

wherein a is 0 to 4, b is 0 to 3 and m is 0 to 5.

Many of the compounds eligible for use in the practice of this invention are suitable for salt formation and/or chelation with metals. Examples of suitable metals are alkaline earth metals such as Ca, Ba, Sr, or transition metals such as Mn, Ni, Cu, Zn, Cr or Co. Compounds suitable for salt formation are those which carry sulfo and/or carboxyl groups. The skilled person will recognise chelate formers from the presence of coordinating ligand atoms.

Examples of such compounds are:

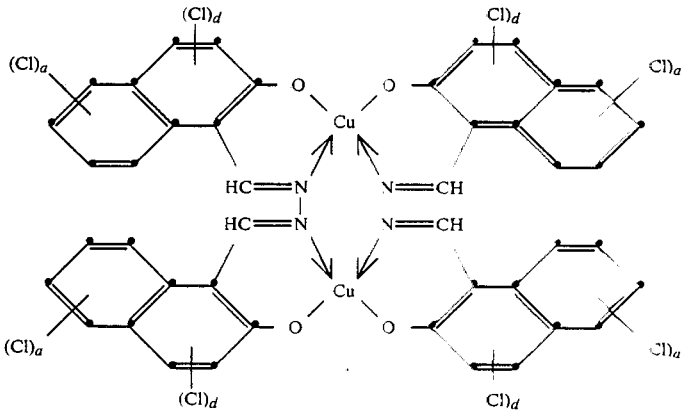

-continued

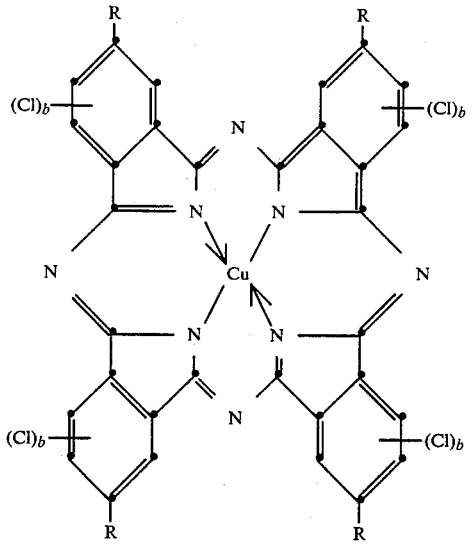

wherein R is hydrogen, chlorine or a group

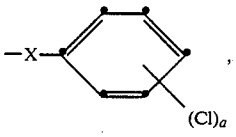

wherein X is oxygen or sulfur,

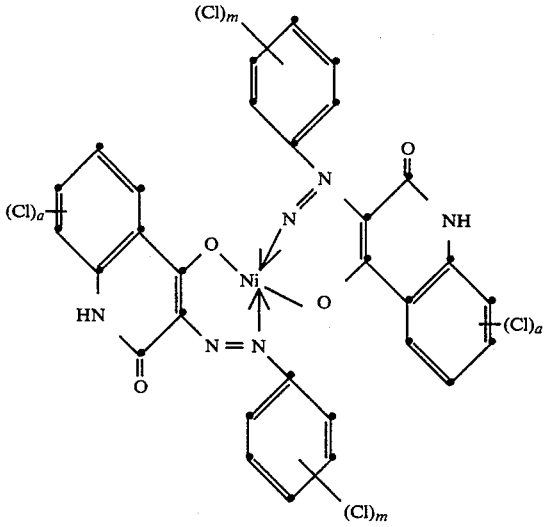

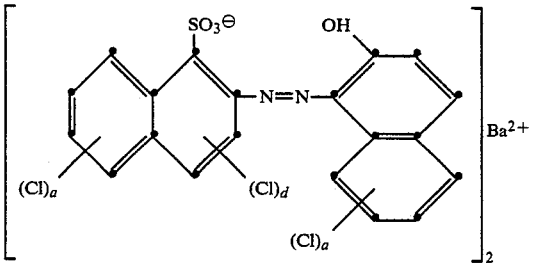

-continued

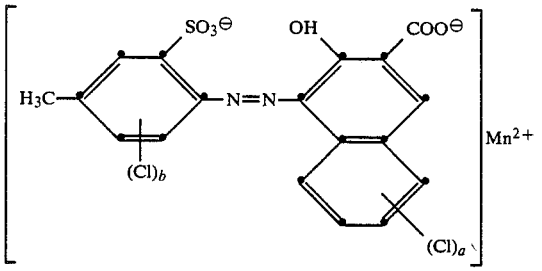

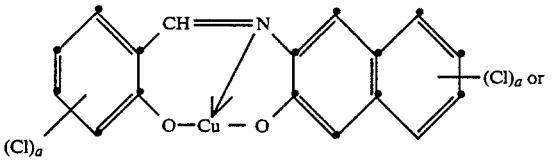

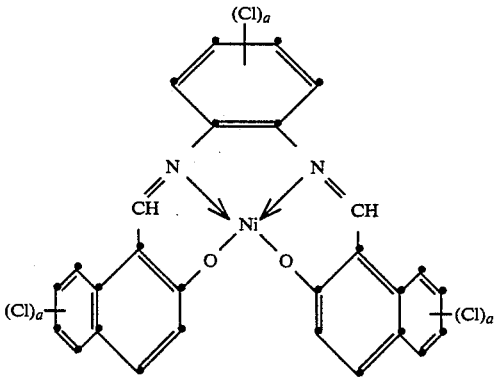

wherein a is 0 to 4, b is 0 to 3, d is 0 or 2 and m is 0 to 5.

Preferred compounds are those in which the completely unsaturated moieties are derived from benzene or naphthalene, the partially saturated aromatic moieties are fluorene radicals, and the moieties which contain hetero-atoms are quinoline, triazine, imidazole, isoindoline, isoindolinone, benzoxazole, thioindoxyl, 1,3-isoindoledione, anthraquinone, 1,3-indanedione, pyrazolone, anthrapyrimidine or barbituric acid radicals.

In preferred compounds, two, three or four of the completely unsaturated or partially saturated moieties which may also contain hetero-atoms are linked to a molecule. The most important linkages are: the direct bond, a double bond through —O—, —S—, —N(R)—, —N=, alkylene, —NHCO—, —N=N—and —N=N—CH—($COCH_3$)CONH—, wherein R has the meaning previously assigned to it.

Preferred eligible oil-insoluble aromatic compounds which are chlorine-substituted in the nucleus contain 2 to 24, preferably 2 to 16, chlorine atoms per molecule. Preferred compounds are those having a chlorine content of 10 to 75% by weight, most preferably 25 to 50% by weight. It has been found that oil-insoluble, dispersible aromatic compounds which do not contain chlorine are inactive.

By oil-insoluble compounds are meant those compounds which have a solubility at room temperature of less than 50 mg/l in base oil. Soluble compounds have a tendency to recrystallisation, a phenomenon which is observed in an unwanted growth of the dispersed particles and ultimately results in flocculation.

The compounds eligible for use in this invention and the preparation thereof are known. Any individual compounds which may be novel can be obtained by methods similar to known ones and they also constitute an object of the invention. Compounds which belong to this class of lubricant additives are known in particular in dyestuff and pigment chemistry as intermediates or dyes. In this connection, attention is drawn to e.g. the compilation made by K. Venkataraman in "The Chemistry of Synthetic Dyes", Academic Press Inc., New York.

The compounds to be used in this invention impart excellent extreme pressure properties to the lubricants which it is desired to improve. Compared with conventional extreme pressure additives, the compounds eligible for use in the practice of this invention have an improved long-term stabilisation. This feature is especially important if the parts to be lubricated are exposed to extremely severe and prolonged conditions of load.

In the lubricating oil compositions of this invention it is essential that the dispersions are in the liquid state. With a maximum kinematic viscosity of 1000 $mm^2/s$ at 40° C., these compositions are superior in fluidity to the softest gear fluids of consistency class NLGI 000 (according to DIN 51 818). Preferred oils have a kinematic viscosity of 5 to 1000 $mm^2/s$ and, in particular, 5 to 600 $mm^2/s$, at 40° C. It is also important that the additives are in readily dispersible form, which they are for example if the particle size is about 0.1 to 0.8$\mu$. The preferred particle sizes are from about 0.3 to 0.5$\mu$.

It is therefore critical that oil-insoluble, dispersible aromatic compounds which are chlorine-substituted in the nucleus are not added in too large amounts. Amounts of 0.01 to 4.5% by weight, preferably 0.1 to 3% by weight, based on the lubricating oil, influence the fluidity of the oil only to an insignificant degree, as a consequence of which it remains fluid in consistency. Lubricants which contain larger amounts of additives have a tendency to undersirable thickening or even hardening.

The suitable lubricants are known to the skilled person and are described for example in the "Schmiermittel Taschenbuch" (Hüthig Verlag, Heidelberg, 1974). Mineral oils and synthetic hydrocarbons are preferred.

The lubricating oil formulations can contain still further additives which are added to improve certain base oil properties, for example antioxidants, metal deactivators, rust inhibitors, viscosity index improvers, pour-point depressors, dispersants/surfactants and wear resisting additives.

Examples of antioxidants are:

(a) Alkylated and non-alkylated aromatic amines and mixtures thereof, for example: dioctyldiphenylamine, 2,2,3,3-tetramethylbutylphenyl-$\alpha$- and -$\beta$-naphthylamines, phenothiazine, dioctylphenothiazine, phenyl-$\alpha$-naphthylamine, N,N'-di-sec-butyl-p-phenylenediamine.

(b) Sterically hindered phenols, for example: 2,6-di-tert-butyl-p-cresol, 4,4'-bis-(2,6-diisopropylphenol), 2,4,6-tert-butylphenol, 4,4'-methylene-bis-(2,6-di-tert-butylphenol).

(c) Alkyl-, aryl- or alkarylphosphites, for example: trinonylphosphite, triphenylphosphite, diphenyldecylphosphite.

(d) Esters of thiodipropionic acid or thiodiacetic acid, for example: dilaurylthiodipropionate or dioctylthiodiacetate.

(e) Salts of carbamic and dithiophosphoric acids, for example: antimony diamyldithiocarbamate, zinc diamyldithiophosphate.

(f) A combination of two or more of the above antioxidants, for example: an alkylated amine and a sterically hindered phenol.

Examples of metal deactivators are:

(a) for copper, e.g.: benzotriazole, tetrahydrobenzotriazole, 2-mercaptobenzotriazole, 2,5-dimercaptothiadiazole, salicylidene propylenediamine, salts of salicylaminoguanidine.

(b) for lead, e.g.: sebacid acid derivatives, quinizarine, propyl gallate.

(c) A combination of two or more of the above additives.

Examples of rust inhibitors are:

(a) Organic acids, the esters, metal salts and anhydrides thereof, e.g.: N-oleyl sarcosine, sorbitan monooleate, lead naphthenate, dodecenylsuccinic anhydride.

(b) Nitrogen-containing compounds, for example:

I. Primary, secondary or tertiary aliphatic or cycloaliphatic amines and amine salts of organic and inorganic acids, for example oil-soluble alkylammonium carboxylates.

II. Heterocyclic compounds, e.g. substituted imidazolines and oxazolines.

(c) Phosphorus-containing compounds, for example: amine salts of phosphoric acid partial esters.

(d) Sulfur-containing compounds, for example: barium dinonylnaphthalenesulfonates, calcium petroleum sulfonates.

(e) Combinations of two or more of the above additives.

Examples of viscosity index improvers are:

polymethylacrylates, vinyl pyrrolidone/methacrylate copolymers, polybutene, olefin copolymers, styrene/acrylate copolymers.

Examples of pour-point depressors are:

polymethacrylates, alkylated naphthalene derivatives.

Examples of dispersants/surfactants are:

polybutenylsuccinimides, polybutenylphosphonic acid derivatives, basic magnesium, calcium and barium sulfonates, phenolates and naphthenates. Dispersants are employed e.g. in concentrations of 0.1 to 1% by weight, based on the lubricant.

Examples of wear resisting additives are:

Most preferred is the combination of the additives eligible for use in the practice of this invention with the antiwear additives which are known to the skilled person. These are employed in concentrations of 0.01 to 2% by weight, preferably of 0.1 to 1% by weight, based on the lubricant. The ratio of insoluble additive to antiwear additive is 1:5 to 20:1, preferably 1:1 to 10:1.

Compounds containing sulfur and/or phosphorus and/or halogen, e.g. sulfurised vegetable oils, and also monothiophosphates, dialkyldithiophosphates or their zinc salts, tritolylphosphates, chlorinated paraffins, alkyl and aryl disulfides, reaction products of olefins or olefincarboxylic acids with sulfur, phosphate esters or thionophosphates.

The following compounds may be cited as examples of particularly useful antiwear additives:

Phosphate esters of the formula I

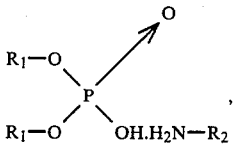

(I)

wherein $R_1$ is $C_1$–$C_{18}$alkyl such as methyl, ethyl, isopropyl, n-propyl, n-butyl, sec-butyl, tert-butyl, amyl or straight chain or branched hexyl, octyl, nonyl, decyl, dodecyl, tetradecyl, hexadecyl or octadecyl, and $R_2$ is $C_8$–$C_{22}$alkyl such as straight chain or branched octyl, nonyl, decyl, undecyl, tetradecyl, hexadecyl, octadecyl, eicosyl or docosyl.

Thiophosphates of the formula II

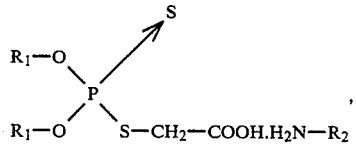

(II)

wherein $R_1$ and $R_2$ are as defined above, but with $R_1$ preferably being $C_3$–$C_{12}$alkyl.

The antiwear additives listed above imply no restriction, but are merely cited as exemplifying an embodiment of the invention.

The following Examples illustrate the invention in more detail.

EXAMPLES

(A) Preparation of the Dispersions

The additives must be in finely particulate, readily dispersible form in order to obtain suitable dispersions. Depending on the particle size, one of the two following methods may for example be employed:

Method 1 (for additives already in finely particulate form): 1 g of additive and 0.2 g of dispersant [OLOA 246 F ® (a calcium petroleum sulfonate)] are ground in 100 g of a mineral oil having a viscosity index of 90–96 with 300 g of glass beads (diameter: 6 mm) for two days on a roller gear table (rate 120/180).

Method 2 (for more coarse grainted powders): 1 g of additive and 0.2 g of dispersants (OLOA 246 F ®) are ground in 100 g of a mineral oil having a viscosity index of 90–96 with 1 kg of steel balls (diameter: 1 cm) for two days on a roller gear table (rate 90).

If convenient, grinding may also be effected without dispersant or the dispersant may be added during or after grinding.

(B) Reichert Test

The wear resistant action of the various dispersions is determined using a conventional lubricant measuring machine (H. Reichert, Maschinen- und Apparatebau). A test cyclinder measuring 2 cm in length and 1 cm in diameter is pressed with a force p against a rotating grinding wheel which rotates at a constant speed of 1.7 m/sec (900 rpm) in an oil bath. The test criterion is the wear indentation as a function of the friction path.

Test Preparations

Wheel and test specimen are cleansed in boiling point petroleum and acetone in an ultrasonics bath. The wheel is then worn in four times with pure base oil (friction path 100 m). With this precisely roughened wheel, a wear indentation of 36–40 $mm^2$ is obtained under standard conditions (friction path 100 m, p=14.7N) with pure base oil. This value was verified four times before the actual test.

Test Procedure

The dispersions are tested under standard conditions (friction path 100 m, p=14.7N). An effective dispersion reduces the wear indentation markedly.

(C) Four ball test

The following values are determined using the Shell four-ball apparatus (Tentative Method IP 239/69, Extreme Pressure and Wear Lubricant Test for Oils and Greases).

(1) I.S.L.=initial seizure load: the load at which the oil film breaks up within 10 seconds (2) W.L.=weld load: the load at which the 4 balls become welded within 10 seconds (3) W.S.D.=wear scar diameter in mm: the average wear diameter at a load of 70 kg and 40 kg over 1 hour.

(D) Corrosion Test

This test is carried out in accordance with AATM 665 B and the rigorous procedure of DIN 51 355. Evaluation is made using a rating scale in which 0 denotes no corrosion and 1, 2, 3 and 4 denote increasingly severe corrosion. The value 4 can only occur in the DIN test.

(E) Additives

The following additives are tested for their efficacy and properties alone and in the presence of a conventional antiwear additive. It is conspicuous that, in spite of substantial structural differences, the result is good if the common requirements made of the structure are fulfilled.

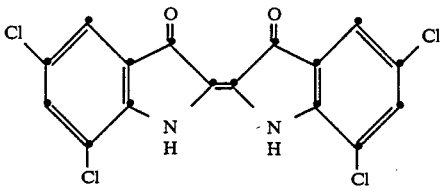

(additive 1)

-continued (additive 2)

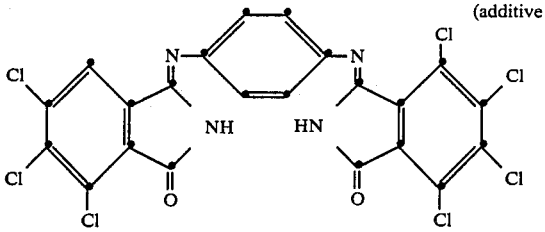

(additive 3)

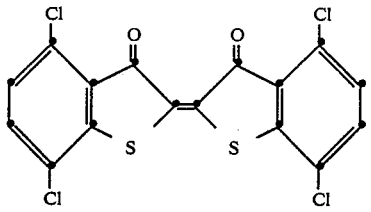

(additive 4)

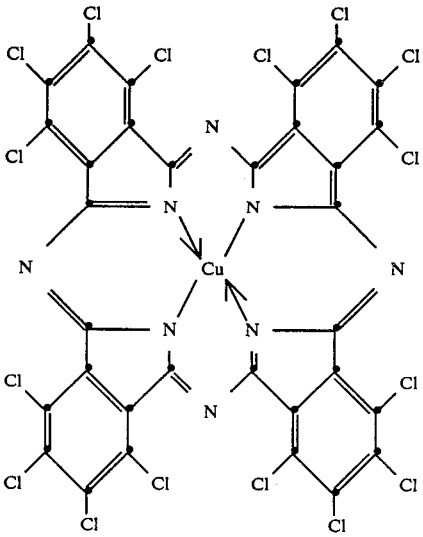

(additive 5)

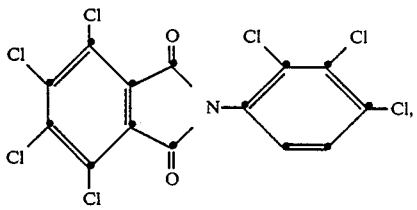

(additive 6)

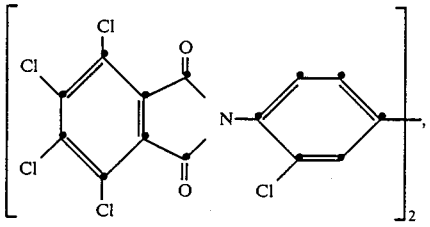

-continued additive 7)

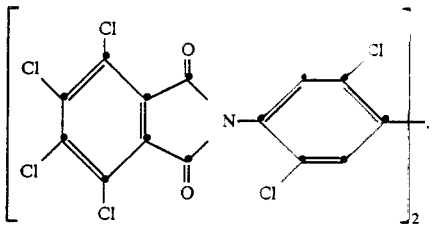

additive 8)

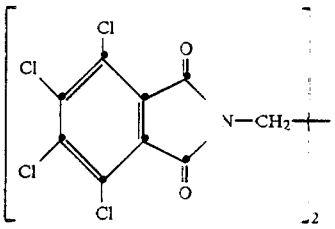

additive 9)

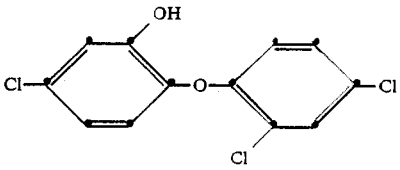

additive 10)

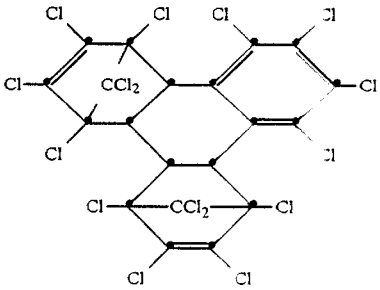

additive 11)

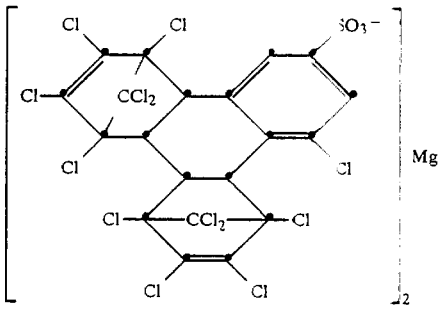

EXAMPLE 1

The values reported in the table below are determined in the Reichert test (see B) above). The dispersions are prepared as in Method A1 or A2 and contain 1% by weight of additive and 0.2% by weight of dispersant (OLOA 246 F®). Friction path 100 m, p=14.7N. The base oil employed is ISO VG 100®.

| Additive | Wear identation [mm²] |
|---|---|
| none (without dispersant) | 40 |
| none (with dispersant) | 40 |
| 1 | 18.0 |
| 2 | 12.8 |

-continued

| Additive | wear identation [mm²] |
|---|---|
| 3 | 9.9 |
| 4 | 9.0 |
| 5 | 13.1 |
| 6 | 11.4 |
| 7 | 13.8 |
| 8 | 14.1 |

EXAMPLE 2

The values reported in the table below are obtained in the four-ball test (see C) above). Once again the dispersions may be prepared by methods A1 or A2. The base oil ISO VG 100® contains 1% by weight of additive and 0.2% by weight of dispersant (OLOA 246 F®).

| Additive | ISL (kg) | WL (kg) | WSD (mm) |
|---|---|---|---|
| none | 40 | 160 | 0.9 |
| 2 | 70 | 270 | 0.9 |
| 3 | 60 | 270 | 0.8 |
| 4 | 70 | 310 | 0.95 |
| 9 | | >200 | 0.6 |
| 10 | | >200 | 0.9 |
| 11 | | >200 | 0.6 |

EXAMPLE 3

The procedure of Example 2 is repeated, using instead of the neutral dispersant 0.4% by weight of the alkaline form (OLOA 246 B®) and 2% by weight of additive as well as additionally 0.1% by weight of an antiwear additive. The following results are obtained:

Antiwear additive AW 1:

$C_6H_{13}OP(O)(OH)_2/(C_6H_{13}O)_2P(O)OH.$Primene 81 R®

(Primene 81 R=mixture of $C_{12}$–$C_{15}$monoalkylamines available from Rohm & Haas, USA).

Antiwear additive AW 2:

$(C_8H_{17}O)_2P(S)S—CH_2COOH.H_2N—C_{12}H_{25}$

| Additive | ISL | WL | WSD |
|---|---|---|---|
| none | 40 | 160 | 0.8 |
| 4 + AW 1 | 120 | 240 | 0.45 |
| 4 + AW 2 | 140 | 380 | 0.45 |

EXAMPLE 4

The procedure of Example 2 is repeated, using additionally 0.5% by weight of an antiwear additive AW1, AW2 or AW3 (triphenylphosphonothionate). The following values are obtained:

| Additive | ISL | WL | WSD |
|---|---|---|---|
| none | 40 | 160 | 0.9 |
| 4 | 70 | 300 | 0.8 |
| 4 + AW 1 | 100 | 300 | 0.5 |
| 4 + AW 2 | 100 | 360 | 0.4 |

-continued

| Additive | ISL | WL | WSD |
|---|---|---|---|
| 4 + AW 3 | 90 | 280 | 0.8 |

EXAMPLE 5

The corrosion test of ASTM 665 B or DIN 51 355 B gives the following values (formulations as in Example 2):

| Additive | ASTM 665 B | DIN 51355 B |
|---|---|---|
| none | 3 | 4 |
| 4 | 0 | 0 |
| 4 + 1% AW 1 | 0 | 0 |

What is claimed is:

1. A liquid lubricant composition, having a kinematic viscosity of 2–1500 mm²/s at 40° C., which comprises
   (a) a lubricant , and
   (b) 0.01 to 4.5% by weight, based on the lubricant, of an extreme pressure additive which is a compound of the formula

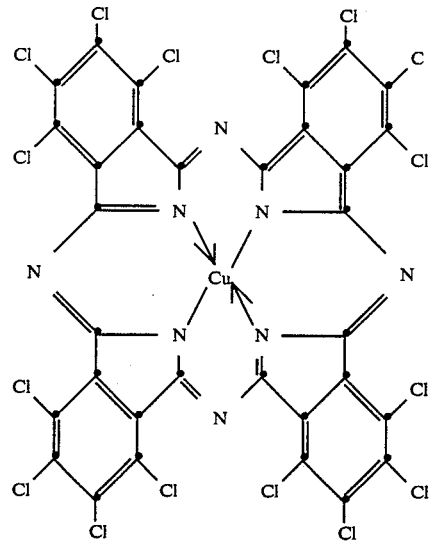

2. A composition according to claim 1 wherein the lubricant is a mineral oil.
3. A lubricant composition according to claim 1, having a kinematic viscosity of 5–600 mm²/s at 40° C.
4. A lubricant composition according to claim 1, which contains 0.1 to 3% by weight of an extreme pressure additive.
5. A lubricant composition according to claim 1, which additionally contains an antiwear additive.
6. A lubricant composition according to claim 5, wherein the antiwear additive is $C_6H_{13}OP(O)(OH)_2/(C_6H_{13}O)_2P(O)OH.H_2N—C_{12}H_{25}$ or $(C_8H_{17}O)_2P(S)SCH_2COOH.H_2N—C_{12}H_{25}$ 7. A lubricant composition according to claim 1, which additionally contains a dispersant.
8. A lubricant composition according to claim 7, wherein the dispersant is a calcium petroleum sulfonate.

* * * * *